United States Patent [19]

Itakura

[11] 4,137,016

[45] Jan. 30, 1979

[54] VALVE MECHANISM FOR AN AIR PUMP

[75] Inventor: Tsuyoshi Itakura, Tokyo, Japan

[73] Assignee: Itakura Soki Co., Ltd., Tokyo, Japan

[21] Appl. No.: 821,817

[22] Filed: Aug. 4, 1977

[30] Foreign Application Priority Data

Jan. 24, 1977 [JP] Japan ..... 52-7174[U]

[51] Int. Cl.[2] ..... F04B 43/04; F04B 39/10

[52] U.S. Cl. ..... 417/413; 417/566; 137/855

[58] Field of Search ..... 417/566, 413; 137/855; 220/352

[56] References Cited

U.S. PATENT DOCUMENTS

| | | | |
|---|---|---|---|
| 2,266,270 | 12/1941 | Roth | 220/352 |
| 2,961,149 | 11/1960 | Hull | 417/566 |
| 3,005,523 | 10/1961 | May | 417/566 |
| 3,314,600 | 4/1967 | Hadley | 417/566 |
| 3,613,935 | 10/1971 | Rogge | 220/352 |
| 3,671,151 | 6/1972 | Duke et al. | 417/413 |
| 3,821,966 | 7/1974 | Small | 137/855 |
| 3,825,374 | 7/1974 | Rondo | 417/413 |
| 3,830,596 | 8/1974 | Rondo | 417/413 |

FOREIGN PATENT DOCUMENTS

| | | | |
|---|---|---|---|
| 983779 | 2/1965 | United Kingdom | 137/855 |

*Primary Examiner*—William L. Freeh

*Attorney, Agent, or Firm*—Eliot S. Gerber

[57] ABSTRACT

An improved valve mechanism for a small sized air pump, having valve elements each of which is secured in a housing of a valve casing. The valve element has a semi-circular portion and a tongue. The semi-circular portion is trapezoidal and snuggly and firmly positioned within the housing.

4 Claims, 7 Drawing Figures

VALVE MECHANISM FOR AN AIR PUMP

BACKGROUND OF THE INVENTION

The present invention relates to a valve mechanism for a small sized air pump which sends air into, for example, a water tank for an ornamental, appreciative tropical fish.

The small sized air pump used in the aforementioned field is operated by vibrating a drum-like membrane by an electromagnet to thereby permit a function of the valve. In the conventional valve mechanism, inlet and outlet valves, each of which has a tongue, valve body and a leg, are tightly positioned on beds of a pump casing such that the leg of the valve is snugly inserted into, and tightly connected to, a hole formed on the bed. According to the conventional valve mechanism, however, the applicant has found some disadvantages such that the valves are swayed from side to side or pivoted about the leg during the operation of the air pump.

An attempt has been made to improve the aforementioned valve mechanism. In the attempt, sleeves are integrally formed with the both sides of the tongue wherein each of the sleeves has a leg which is tightly inserted into the hole of the bed. Accordingly, the valve is fixed to the bed of the casing by means of two legs of the sleeves. However, the applicant has found that the valve produces noises in operation though the sleeves of the valve are tightly connected to the bed of the casing. The applicant believes that the above-descirbed noise is due to the structure that the sleeves of both ends of the tongue are firmly connected to the bed. Furthermore, it is awkwardly troublesome to assemble the valve into the pump casing since two legs of the valve should be firmly and snugly inserted into the holes of the bed.

Accordingly, an object of the present invention is to provide an improved valve mechanism which permits a reliable function of the valve.

Another object of the present invention is to provide an improved valve mechanism which permits an accurate and easy assembly.

Further object of the present invention is to provide an improved valve mechanism which does not produce an unpleasant noise in operation.

Additional object of the present invention is to provide an improved valve mechanism which is produced economically.

Other objects and features of the present invention will become apparent from the detailed description of the preferred embodiment thereof, which will be read with reference to the accompanying drawings.

DETAILED DESCRIPTION OF THE INVENTION

Figure 1:
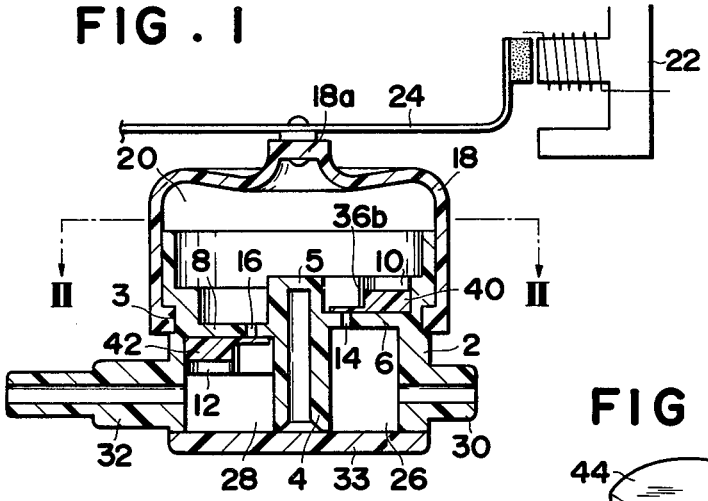
FIG. 1 is a sectioned view of a valve mechanism of an air pump, embodying the present invention.
Figure 4:
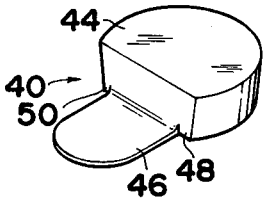
FIG. 4 is a perspective view of a valve according to the present invention.
Figure 2:
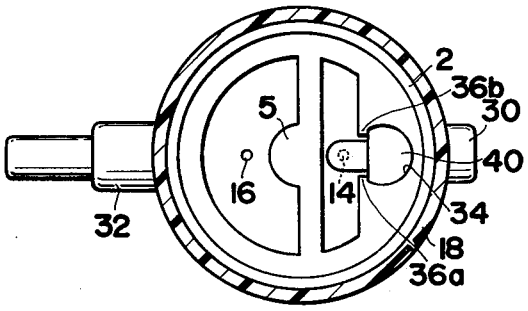
FIG. 2 is a sectioned view taken along II—II of FIG. 1.
Figure 5:
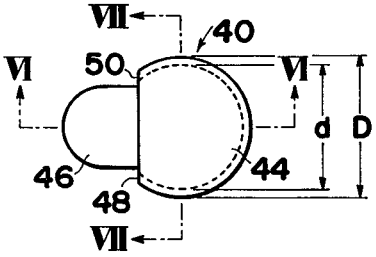
FIG. 5 is a top plan view of the valve illustrated in FIG. 4.

In FIGS. 1 and 2, a valve mechanism of an air pump has a cylindrical casing 2 of plastics. The casing 2 has a tubular member 4 at the centeral or axial portion of the casing, beds 6 and 8 which are supported by the casing 2 and the tubular member 4. The tubular member 4 is closed at one end 5. Above the bed is formed a valve housing 10 which is confined by the walls (not shown) of the casing 2, and similarly a valve housing 12 is formed below the bed 8. The beds 6 and 8 have holes 14 and 16, respectively, at the place adjacent to the tubular member 4. The casing 2 has an annular recess 3 around the external surface thereof. A cup-like membrane 18 which is made of a suitable resilient material such as rubber or the like is tightly connected to the casing such that the open end portion of the membrane is snugly and tightly engaged with the recess 3 of the casing. Thus, the upper portion of the casing 2 is sealed with the cup-shaped membrane 18 to form a chamber 20.

The membrane 18 has an extended central portion 18*a* and is connected to an electromagnet 22 through a member 24.

An inlet chamber 26 and an outlet chamber 28 are formed lower portion of the casing 3. The chambers 26 and 28 are confined by the casing and the tubular member 4. The lower end of the casing 3 is sealed with a cover member 33 in such a manner that not only the lower end of the casing but also the lower end of the tubular member is connected to the cover member 4. An inlet nozzle 30 and an outlet nozzle 32 are connected to the inlet chamber 26 and the outlet chamber 28, respectively.

Figure 3:
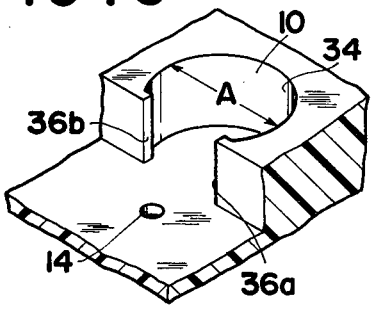
FIG. 3 is a fragmentary, perspective view of a valve housing in which the valve is secured.

In FIG. 3 which illustrates the valve housing 10 and 12, the both housings are of similar structure and therefore one of them is described with reference to FIG. 3. The housing 10 is confined with a semi-circular wall 34 and has two opposing protrusions 36*a* and 36*b* at the termination of the wall 34. The protrusions 36*a* and 36*b* are formed integrally with the casing 2.

Figure 6:
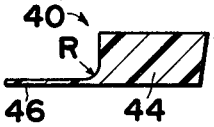
FIG. 6 is a sectioned view of the valve illustrated in FIG. 4.
Figure 7:
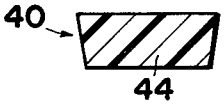
FIG. 7 is a sectioned view of the valve, taken along VI—VI of FIG. 5(*a*).

Valves 40 and 42 which are made of resilient material such as rubber or synthetic resins are snugly placed on the beds 6 and 8, respectively. The valve 40 will be described with reference to FIGS. 4, 5, 6, and 7 since the other valve 42 is quite similar with the valve 40. The valve 40 has a semi-circle shaped body 44 and a tongue 46 which functions as a valve. The tongue 46 is formed integral with the semi-circle shaped body 44. Preferably, the starting portion of the tongue 46 has thickness greater than the thickness of the other part of the tongue so that the resilient force of the tongue may become greater, and is round shaped as illustrated at R in FIG. 6. The semi-circle shaped body 44 has a top flat face which is greater in diameter than the bottom flat face, the latter being equal or slightly greater than the diameter (A) of the semi-circled housing 10 (FIG. 3). In other words, as illustrated in FIGS. 3 and 6, the diameter (D) of the top of the valve body 40 is greater than the diameter (d) of the bottom, whereas the diameter (d) is equal or slightly greater than the diameter (A) of the valve housing 10. The semi-circled body 44 is trapezaidal in cross section as shown in FIG. 7. Further, the tongue 46 has a width smaller than the width of the flat side of the semi-circle shaped body 44 to form shoulders 48 and 50 adjacent to the starting end of the tongue 46.

An assembly of the valves will be described. The valve 40 is inserted into the valve housing 10 against the resilient force of the valve such that the same is snugly and tightly secured within the housing and that the tongue closes the hole 14 of the bed 6. Similarly, the valve 42 is inserted into the valve housing 12. After the valves are firmly secured, in position, within the housings 10 and 12, the cup-like membrane 18 is connected to the one end of the casing as shown in FIG. 1, and the cover member 33 is fixed to the other end of the casing so that no air space is present between the cover member 33 and the ends of the casing 2 and tubular member 4. Thus, the lower end of the chambers 26 and 28 are fully sealed with the cover member 33. The insertion of the valves 40 and 42 into the valve housing 10 and 12 will be readily carried out by contacting the shoulders 48 and 50 to the protrusions 36*a* and 36*b* of the housings and then pushing the valves toward the beds 6 and 8 of the casing 2 until the bottom surface of the valves fully contact the beds.

In operation, the electromagnet 22 is switched on to vibrate the member 24 and the membrane 18. Consequently, the tongues 46 of the valves 40 and 40 are vibrated such that the holes 14 and 16 are alternately closed and opened to thereby pump out from the outlet nozzle 32 an air which was introduced from the inlet nozzle 30.

According to the valve mechanism of the present invention, it allows a simple and easy assembly of the valves and a bulk fabrication of the elements. Further, the valves are firmly secured within the valve housings and the valves do not produce any noise in operation.

Though the present invention has been described with reference to the preferred embodiment thereof, many modification and alterations may be made within the spirit of the invention.

What is claimed is:

1. A valve mechanism for an air pump comprising:

a cylindrical casing which has a first valve housing having a bed and a second valve housing having a bed;

said first and second housings having semi-circular walls and opposed protrusions at the termination of said semi-circular walls, said first and second housings having holes at the beds thereof, a cup-like membrane of resilient materials;

the open end of said membrane being connected to said cylindrical casing to form a chamber at one end of said casing, the closed end of said membrane being connected to a vibration device, a cover member fixed to the other end of said casing;

a first chamber connected to the hole of said first housing and a second chamber connected to the hole of said second housing;

an inlet nozzle connected to said first chamber and an outlet nozzle connected to said second chamber;

a first valve element which has a semi-circular body having a flat side and a tongue extending from the lower end of said semi-circular body;

said semi-circular body being trapezoidal and having upper diameter greater than the lower diameter, said first valve element being secured within said first housing, said tongue having a width smaller than the length of said flat side of said semi-circular body to form shoulders at the starting end of the tongue, a second valve element which has a semi-circular body having a flat side and a tongue extending from the lower end of said semi-circular body;

said semi-circular body being trapezoidal and having upper diameter greater than the lower diameter, said second valve element being secured within said second housing, said tongue having a width smaller than the length of said flat side of said semi-circular body to form shoulders at the starting end of the tongue, said first valve element being secured within said first housing and said second valve element being secured within said second housing.

2. The valve mechanism accordance with claim 1, in which the diameter of the lower surface of said semi-circular body of the valve elements is slightly larger than the diameter of the first and second housing confined by the semi-circular walls.

3. The valve mechanism in accordance with claim 1, in which said tongue is formed integral with said semi-circular body and has a round surface at the starting portion thereof.

4. The valve mechanism in accordance with claim 1, in which said valve elements are made of resilient material.

* * * * *